US007804017B2

(12) United States Patent
Hata et al.

(10) Patent No.: US 7,804,017 B2
(45) Date of Patent: Sep. 28, 2010

(54) ELECTRONIC MUSICAL INSTRUMENT

(75) Inventors: Kyosuke Hata, Hamamatsu (JP); Yutaka Yoshida, Hamamatsu (JP)

(73) Assignee: Roland Corporation, Shizuoka-ken (JP)

( * ) Notice: Subject to any disclaimer, the term of this patent is extended or adjusted under 35 U.S.C. 154(b) by 43 days.

(21) Appl. No.: 12/135,110

(22) Filed: Jun. 6, 2008

(65) Prior Publication Data

US 2009/0301286 A1 Dec. 10, 2009

(51) Int. Cl.
*G10H 1/32* (2006.01)

(52) U.S. Cl. ..... 84/644; 84/670; 84/718; 84/719; 84/743; 84/744

(58) Field of Classification Search ..... 84/644, 84/670, 718, 719, 743, 744
See application file for complete search history.

(56) References Cited

U.S. PATENT DOCUMENTS 2,974,555 A * 3/1961 Andersen ..... 84/733
3,887,275 A * 6/1975 Heist ..... 353/74
4,372,629 A * 2/1983 Propst et al. ..... 312/223.6
4,654,756 A * 3/1987 Wilson et al. ..... 361/827
4,734,826 A * 3/1988 Wilson et al. ..... 361/827
4,792,881 A * 12/1988 Wilson et al. ..... 361/827
5,230,552 A * 7/1993 Schipper et al. ..... 312/223.6
5,231,562 A * 7/1993 Pierce et al. ..... 361/832
5,552,560 A * 9/1996 Ura ..... 84/653
5,765,932 A * 6/1998 Domina et al. ..... 312/223.6
5,860,713 A * 1/1999 Richardson ..... 312/223.6
5,864,078 A * 1/1999 Koevering ..... 84/478
5,886,295 A * 3/1999 Carino et al. ..... 174/481
6,024,599 A * 2/2000 Stathis et al. ..... 439/535
6,028,267 A * 2/2000 Byrne ..... 174/59
6,042,426 A * 3/2000 Byrne ..... 439/654
6,085,667 A * 7/2000 Gevaert et al. ..... 108/50.02
6,218,602 B1 * 4/2001 Davis et al. ..... 84/477 R
6,254,206 B1 * 7/2001 Petrick et al. ..... 312/223.6
6,254,427 B1 * 7/2001 Stathis ..... 439/535
6,327,983 B1 * 12/2001 Cronk et al. ..... 108/50.02
6,397,762 B1 * 6/2002 Goldberg et al. ..... 108/50.02
6,435,106 B2 * 8/2002 Funk et al. ..... 108/50.02
6,717,053 B2 * 4/2004 Rupert ..... 174/53
6,895,868 B1 * 5/2005 Cronk et al. ..... 108/50.02
6,979,768 B2 12/2005 Ito
7,238,872 B1 * 7/2007 Edwards et al. ..... 84/486
7,312,393 B2 * 12/2007 McCarthy ..... 174/53
7,332,669 B2 * 2/2008 Shadd ..... 84/742
7,375,273 B2 * 5/2008 Sawyer-Kovelman et al. . 84/609
2001/0052284 A1 * 12/2001 Kondo et al. ..... 84/718

(Continued)

FOREIGN PATENT DOCUMENTS

JP 61186292 11/1986

(Continued)

*Primary Examiner*—David S. Warren
(74) *Attorney, Agent, or Firm*—David W. Victor; Konrad Raynes & Victor LLP

(57) ABSTRACT

An electronic musical instrument includes a keyboard having a plurality of keys, a top board located in the rear of the keyboard and having a space for placing external equipment, a music stand that is erected on the top board, and a plurality of connection terminals that are located in the rear of the music stand and on a top surface of the top board, and that are freely connected with and disconnected from the external equipment.

18 Claims, 8 Drawing Sheets

U.S. PATENT DOCUMENTS

| | | | | |
|---|---|---|---|---|
| 2003/0100965 | A1 * | 5/2003 | Sitrick et al. | 700/83 |
| 2004/0040433 | A1 * | 3/2004 | Errico | 84/477 R |
| 2007/0175316 | A1 * | 8/2007 | Kumarova | 84/609 |
| 2008/0092723 | A1 * | 4/2008 | Sawyer-Kovelman et al. | 84/724 |

FOREIGN PATENT DOCUMENTS

| | | | |
|---|---|---|---|
| JP | 06004071 | A * | 1/1994 |
| JP | 3000303 | | 6/1994 |
| JP | 2000250544 | | 9/2000 |
| JP | 2004094160 | | 3/2004 |
| JP | 2004325594 | A * | 11/2004 |

* cited by examiner

ELECTRONIC MUSICAL INSTRUMENT

BACKGROUND

1. Field

The present invention relates to electronic musical instruments, and more particularly, to electronic musical instruments that can be readily connected to or disconnected from external equipment.

2. Related Art

An electronic musical instrument having a keyboard is generally equipped with many connection terminals in the back surface of the case that is provided at the back of the keyboard. These connection terminals include many different kinds of terminals in various shapes for input and output of various types of signals, such as, for example, MIDI terminals that conform to MIDI standard for connection to other electronic musical instruments and personal computers, analog output terminals for outputting analog audio signals and digital output terminals for outputting digital audio signals to amplifiers and the like, analog input terminals for inputting audio analog signals and digital input terminals for inputting digital audio signals from external equipment, power supply terminals for supplying electrical power to external equipment, and the like.

Therefore, when the performer wants to make electrical connections to external equipment, the performer visually checks the connection terminals provided at the back of the electronic musical instrument, and connects the connection terminals of the connecting cords to desired ones of the connection terminals. When the external equipment is to be removed, the performer similarly, visually checks the connection terminals in the back, and disconnects the connection terminals of the connecting cords.

FIG. 8 is a rear perspective view of an electronic organ 80, which is an example of an electronic musical instrument in related art. The electronic organ 80 in related art has connection terminals 8 for input and output of audio signals and image signals, provided at a lower side of its back board 6. Furthermore, a power supply cord plug 23 for connecting to a power supply cord is provided adjacent to the connection terminals 8 at the back board 6.

When the connection terminals provided at one end of the connection cords for electrical connection of the external equipment are connected to or disconnected from the connection terminals provided at the back of the electronic musical instrument, the connection terminals provided at the back of the electronic musical instrument need to be visually checked, which requires some space in the back side of the electronic musical instrument. If there is no space at the back side of the electronic musical instrument, then the electronic musical instrument needs to be moved to make some space on the back side to allow for connection or disconnection of the connection terminals, and after connection or disconnection of the connection terminals, the electronic musical instrument needs to be moved to a position for performance.

When the electronic musical instrument is placed on a stage or the like with the rear side of the electronic musical instrument facing the audience, the connection cords and the power supply cord connected to the rear side can be seen by the audience, which gives poor appearance to the rear side.

SUMMARY

Provided is an electronic musical instrument equipped with a keyboard having a plurality of keys, a top board located in the rear of the keyboard and having a space that may be used for placing external equipment, a music stand that may be erected on the top board, and a plurality of connection terminals that are located in the rear of the music stand on a top surface of the top board, and that are freely connected with and disconnected from external equipment.

In a further embodiment, the top board may have a concave section that recedes in the top surface of the top board, and the connection terminals may be provided inside the concave section formed in the top board.

In a further embodiment, the connection terminals may be provided inside the concave section in a manner that the tips of the connection terminals are lower than the top surface of the top board. Accordingly, a broader area can be used in the top surface of the top board when the connection terminals are not used.

In a further embodiment, the top surface of the top board may have a convex portion that protrudes from the top surface of the top board, and the connection terminals may be provided at the convex portion provided on the top board.

In a further embodiment, the connection terminals may be provided in a manner to extend from the convex section toward a side of the electronic musical instrument.

In a further embodiment, the connection terminals may be provided on a back surface of the music stand.

In a further embodiment, the music stand may have a convex portion protruding from its back surface, the connection terminals may be provided at the convex portion formed on the music stand, and the top board may have a concave section formed in the top surface thereof that stores the convex portion formed on the music stand.

In a further embodiment, the music stand may be swingable toward a position above the keyboard about an axis provided on the top surface of the top board.

In a further embodiment, the connection terminals may include a musical sound signal input terminal for inputting musical sound signals, and the electronic musical instrument may further include a sound source that generates musical sounds specified through performance by the keyboard, and a musical sound output device that outputs musical sound signals generated by the sound source and musical sound signals inputted through the connection terminals.

In a further embodiment, the connection terminals may include an image signal input terminal, and the electronic musical instrument may be equipped with a display device that displays an image based on the image signal inputted through the image signal input terminal.

In a further embodiment, the connection terminals may input or output at least one of musical sound signals, image signals, MIDI signals, USB signals, IEEE1394 signals, and electrical power.

DESCRIPTION OF EXEMPLARY EMBODIMENTS

Figure 1:
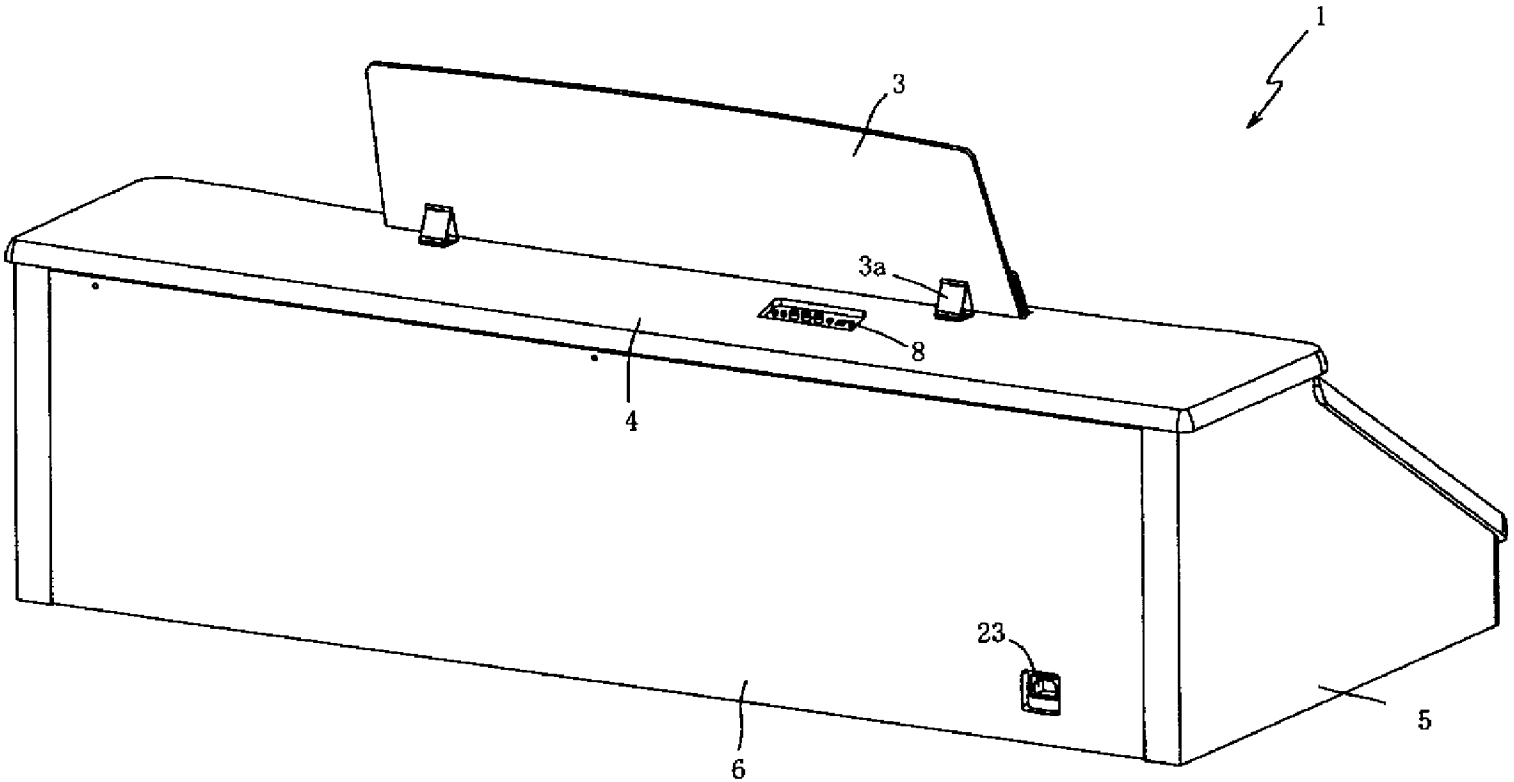
FIG. 1 is a perspective view of an electronic organ in accordance with an embodiment of the invention viewed from its back side.
Figure 2:
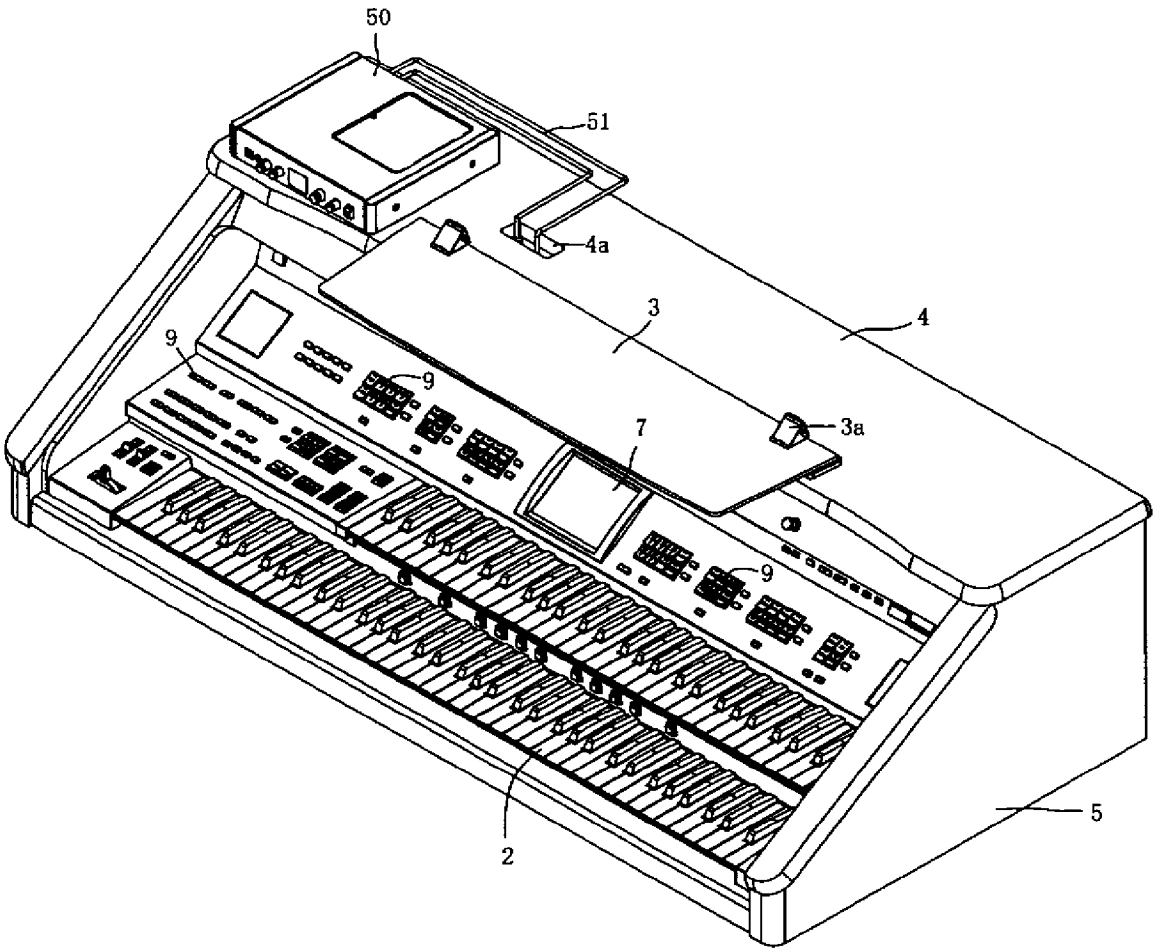
FIG. 2 is a perspective view of the electronic organ viewed from its front side.

Embodiments are described below with reference to the accompanying drawings. FIG. 1 is a perspective view of an electronic organ 1 which is an example of an electronic musical instrument in accordance with certain embodiments, viewed from its back side. FIG. 2 is a perspective view of the electronic organ 1 viewed from its front side. The electronic organ 1 can readily be connected with or disconnected from external equipment.

As shown in FIG. 1 and FIG. 2, the electronic organ 1 is mainly equipped with a keyboard 2 having an upper keyboard and a lower keyboard each equipped with a plurality of keys, side boards 5 arranged on both sides of the keyboard 2, a top board 4 provided in the back of and above the keyboard 2, a music stand 3 arranged on the top board 4, and a back board 6 in the back of the electronic organ 1 downwardly extending from a rear end of the top board 4.

The keyboard 2 includes a plurality of white keys and black keys arranged crosswise, wherein, when the performer depresses any of the keys, the electronic organ 1 detects depressions of the corresponding keys, and generation of musical sounds at pitches designated by the keys is started. When the keys are released, the keys are returned to a horizontal position by the action of springs or the like, and the musical sounds are stopped.

The top board 4 has a horizontal top surface, and has space on both sides of the music stand 3 on the top surface where external equipment 50 can be placed. FIG. 2 shows the state in which the external equipment 50 is placed in the space. The external equipment 50 may be a DVD player, a sound source expansion module, an external storage device, and the like.

With respect to FIGS. 1 and 2, a plurality of connection terminals 8 are provided on the top surface of the top board 4 in the rear of the music stand 3, for input and output of electrical signals between the electronic organ 1 and the external equipment 5. The connection terminals 8 are affixed within an opening 4*a* (concave section) that is formed in the top board 4 in a manner to recede in the top surface, and the connection terminals 8 are provided in a manner to protrude upwardly from the bottom of the opening 4*a*. Tips of the connection terminals 8 are arranged at a position lower than the top surface of the top board 3, such that, when the external equipment 50 is not connected to the connection terminals 8, a wider area can be used in the top surface of the top board 3. The connection terminals 8 may be used to input and output electrical signals, such as, musical sound signals, image signals and MIDI signals, electrical power, and the like.

When the external equipment 50 is a DVD player, audio signals and image signals outputted from the DVD player can be inputted to the electronic organ 1 through those of the connection terminals 8 for inputting audio signals and image signals.

When the external equipment 50 is a sound source expansion module, the electronic organ 1 outputs MIDI signals that conform to MIDI standard through a MIDI terminal among the connection terminals 8, whereby the sound source expansion module can be instructed to generate or stop musical sounds according to the MIDI signals. At this time, audio signals outputted from the sound source expansion module may be inputted in the electronic organ 1 through an audio signal input terminal among the connection terminals 8, and sounds may be generated by speakers provided on the electronic organ 1.

When the external equipment 50 is an external storage device, waveform data and data for setting tone colors stored in the external storage device may be supplied through a MIDI terminal to the electronic organ 1, and in reverse, waveform data and data for setting tone colors stored in the electronic organ 1 may be stored in the external storage device.

A power supply cord plug 23 for connection with a commercial power supply is provided in the back board 6. An inlet connector provided at one end of a power supply cable is connected to the power supply cord plug 23.

The music stand 3 is supported on the top board 4 by hinges 3*b* (see FIG. 3), and supporting metal fittings 3*a* are affixed to the back surface of the music stand 3. As shown in FIG. 1, as the music stand 3 is swung backward and one side of the supporting metal fittings 3*a* are brought in contact with the top board 4, the music stand 3 is erected at a predetermined angle with respect to the top board 4, such that sheet music can be placed on the surface of the music stand 4.

On the other hand, as shown in FIG. 2, as the music stand 3 is swung forward, the music stand 3 is supported generally horizontally. In this state, the connection terminals 8 that are located in the rear of the music stand 3 can be viewed from the side of the keyboard 2. Therefore, when the music stand 3 is swung forward, connection and disconnection between the connection terminals 8 and connection terminals provided at one ends of connection cords 51 connected to the external equipment 50 can more readily be conducted.

When the music stand 3 is swung backward and erected after connecting the connection terminals of the connection cords 51 connected to the external equipment 50 to the connection terminals 8 of the electronic organ 1, the major portion of the connection cords 51 is located behind the music stand 3, and the connection cords 51 becomes almost non-visible to someone viewing the organ from a front perspective view. In this way, the appearance of the electronic organ 1 is not obstructed or cluttered by connection terminals when viewed from the front.

Figure 4:
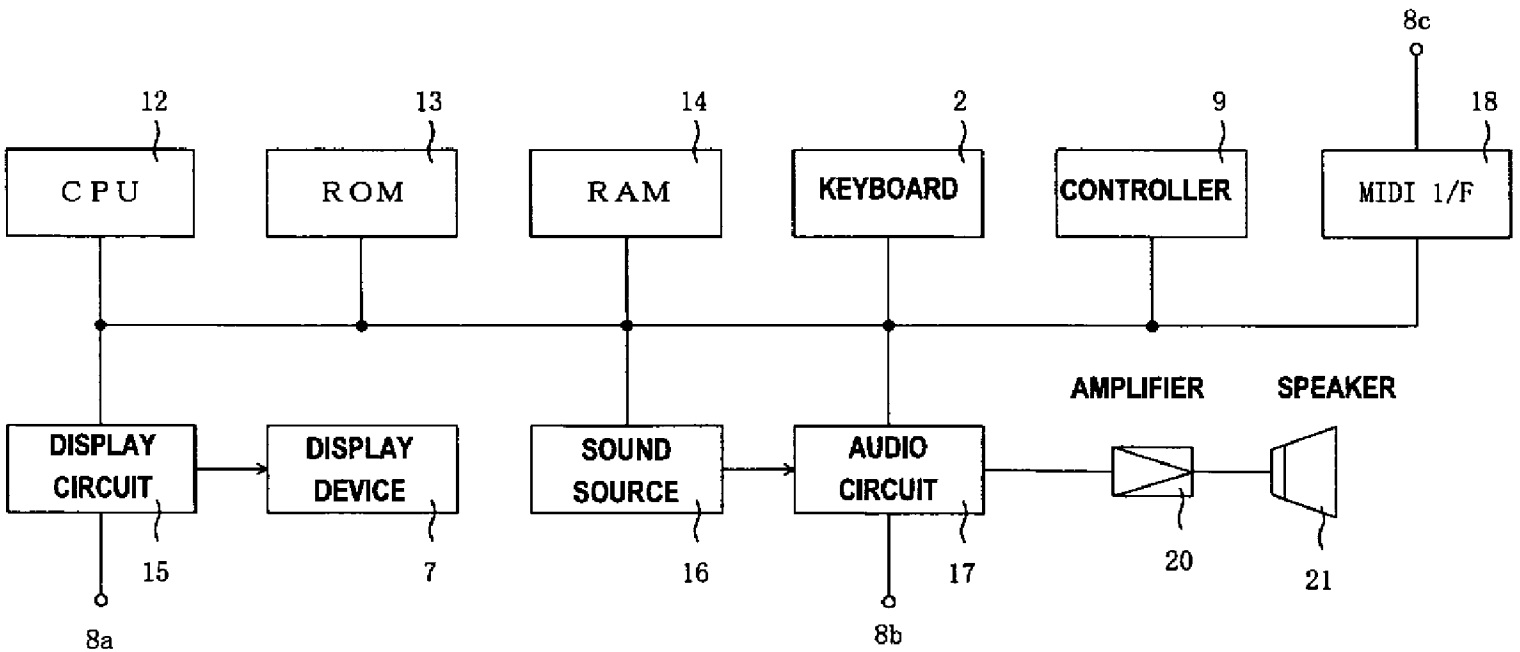
FIG. 4 is a block diagram of an electrical structure of the electronic organ.

Although not shown in FIG. 1 or FIG. 2, a bottom plate is provided at the bottom section of the electronic musical instrument 1 surrounded by the side boards 5 on the two sides and the back board 6, and an electric circuit shown in FIG. 4 is provided on the bottom plate. Power is supplied to the electric circuit from the power supply cord plug 23 provided in the back board 6.

Next, referring to FIG. 3, the music stand 3 is described. The music stand 3 is a rack to place sheet music at a position where the performer can readily read the sheet music when performing at the electronic organ 1. The music stand 3 and the top board 4 are connected to each other by the hinges 3*b*, and the supporting metal fittings 3*a* are affixed to the back surface of the music stand 3.

The hinges 3*b* allow the music stand 3 to swing with respect to the top board 4. Each of the hinges 3*b* is formed from two metal plates that are rotatable about an axis, and the metal plates are affixed to the music stand 3 and the top board 4, respectively, by screws or the like.

The supporting metal fittings 3*a* retain the music stand 3 at a predetermined angle with respect to the top board 4. Each of the supporting metal fittings 3*a* is formed from a metal plate folded in a triangle shape as viewed from its side, and one side thereof is affixed to the music stand 3 by screws or the like.

Figure 3A:
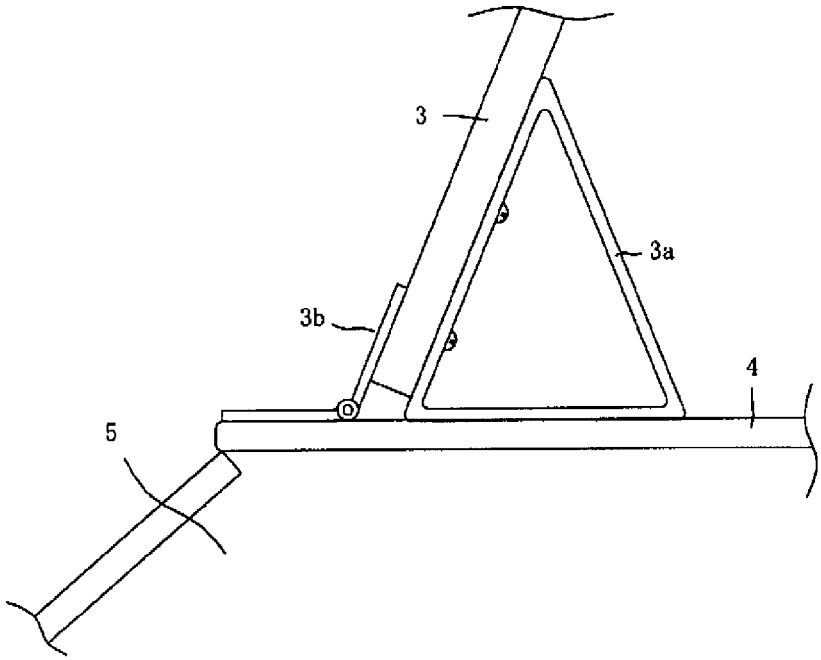
FIGS. 3A and 3B are side elevation views of a structure that is capable of swinging a music stand forward.
Figure 3B:
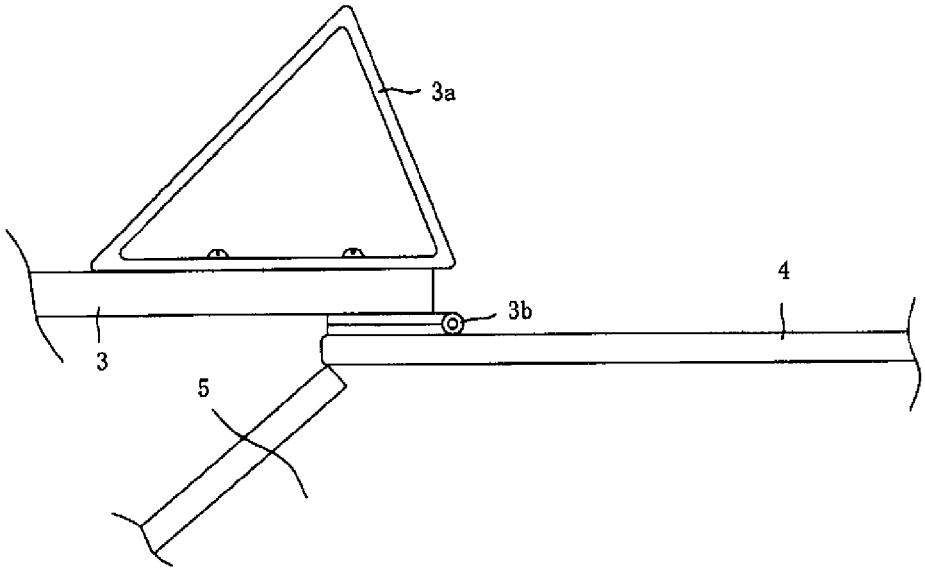

In performance, as shown in FIG. 3A, the music stand 3 is tilted at a predetermined angle and fixedly supported so that the upper surface of the music stand 3 is positioned in a rearwardly inclined direction as viewed from the performer sitting at the organ 1. On the other hand, when the external equipment 50 is placed on or removed from the top board 40, the music stand 3 can be swung forward to a position above the keyboard 2, as shown in FIG. 3B. As a result, the connection terminals 8 disposed on the top board 4 can be viewed, such that connection and disconnection between the connection terminals 8 and the connection terminals of the connection cords 51 is readily accessible to one standing in front of the organ 1.

Next, referring to FIG. 4, an electrical structure of the electronic organ 1 is described. FIG. 4 is a block diagram of the electrical structure of the electronic organ 1. The electronic organ 1 is mainly equipped with a central processing unit (CPU) 12, a read-only memory (ROM) 13 that stores a control program and the like to be executed by the CPU 12, a random access memory (RAM) 14 that has a work memory area required when the CPU 2 executes the control program, a display device 7 that displays parameters that have been set and images to be inputted from the external equipment 50, a display circuit 15 that controls the display device 7, a sound source 16 that generates musical sounds, an audio circuit 17 that processes audio signals generated by the sound source 16, a MIDI interface (I/F) 18, an amplifier 20 and a speaker 21. The electronic organ 1 also includes controllers 9.

The CPU 12, the ROM 13, the RAM 14, the keyboard 2, the controllers 9, the display circuit 15, the sound source 16 and the audio circuit 17 are mutually connected through a bus.

The display circuit 15 is provided with an image input terminal 8*a* for inputting images. The display circuit 15 is capable of receiving image signals outputted from a DVD player that is an example of the external equipment 50, and displaying images on the display device 7. Similarly, the audio circuit 17 is provided with an audio input terminal 8*b* for inputting audio signals. The audio circuit 17 is capable of receiving audio signals outputted from a DVD player that is an example of the external equipment 50, and generating sounds from the speaker 21 through the amplifier 20.

The control program stored in the ROM 13 may be an ordinary performance program for executing ordinary performance of a user manipulating the keyboard 2, a karaoke performance program, and the like. When an ordinary performance is set to be executed, the ordinary performance program is executed. The CPU 12 executes the ordinary performance program, receives information for performance operations played at the keyboard 2, generates control signals corresponding to the performance operations, and transmits the control signals to the sound source 16. When the control signals are inputted, the sound source 16 generates audio signals corresponding to the control signals, and outputs the audio signals to the audio circuit 17. The audio circuit 17 renders specified effects to the audio signals inputted, and outputs the same to the amplifier 20. The amplifier 20 amplifies the audio signals, thereby driving the speaker 21.

The MIDI interface 18 is provided for inputting and outputting MIDI signals, and is provided with a MIDI terminal 8*c* that conforms to MIDI standard. According to the MIDI standard, MIDI signals are inputted or outputted as serial signals, and the MIDI interface 18 converts the serial signals to parallel signals to be transmitted with the CPU 12.

During performance of the electronic instrument 1, when the external equipment 50 is a DVD player, and a disk loaded on the external equipment 50 is played, the external equipment 50 generates audio signals and outputs the audio signals to the audio input terminal 8*b* provided on the audio circuit 17. The audio signals inputted in the audio input terminal 8*b* and the musical sounds provided by the sound source 16 can be mixed and outputted to the amplifier 20. For example, by playing a so-called minus-one disk that stores a musical performance in which one performance part is eliminated, the performer can manipulate the keyboard 2 to play a part in ensemble with the reproduced sounds of the disk.

When the karaoke performance is set to be executed, automatic performance data for karaoke performance and lyrics data to be displayed are initially stored in the RAM 14 through an unshown external storage device and the MIDI interface. The automatic performance data stores data conforming to the MIDI standard which instructs the sound source 16 to generate or stop musical sounds with an elapse of time. Also, the lyrics data stores lyrics to be sung by the singer with an elapse of time corresponding to the automatic performance data.

Next, the CPU 12 executes the karaoke performance program, thereby sequentially reading the automatic performance data from the RAM 14 and transmitting the data to the sound source 16, and at the same time, reading out the lyrics data for a predetermined length at a predetermined time interval from the RAM, transmitting the lyrics data to the display circuit 15 and controlling the display circuit 15 to display the position in the lyrics to be sung according to the progress of the automatic performance.

In the karaoke performance, a disk loaded on the external equipment 50 may be played, whereby audio signals for the accompaniment reproduced by the external equipment 50 may be inputted in the audio input terminal 8*b* provided on the audio circuit 17. The audio signals inputted in the audio input terminal 8*b* may be outputted to the amplifier 20. Also, image signals reproduced by the external equipment 50 may be inputted in the image input terminal 8*a* provided on the display circuit 15, and mixed with the lyrics to be displayed on the display device 7.

In accordance with the embodiments, as described above, the connection terminals 8 for connection with the external equipment 50 are provided on the top board 4 of the electronic organ 1 in the rear of the music stand 3. Therefore, when the external equipment 50 is mounted on or removed from the top board 4, electrical connection and disconnection with the external equipment 50 can readily be made. Furthermore, as the connection terminals are located in the rear of the music stand 3, the connection cables for the connection terminals are hidden in the back of the music stand 3, which improves the appearance of the front view of the instrument 1. Furthermore, the music stand 3 can be swung forward about the hinges 3*b* provided on the top board 4, such that, by swinging the music stand 3 forward, connection and disconnection between the connection terminals 8 and the external equipment 50 can readily be made.

Figure 5:
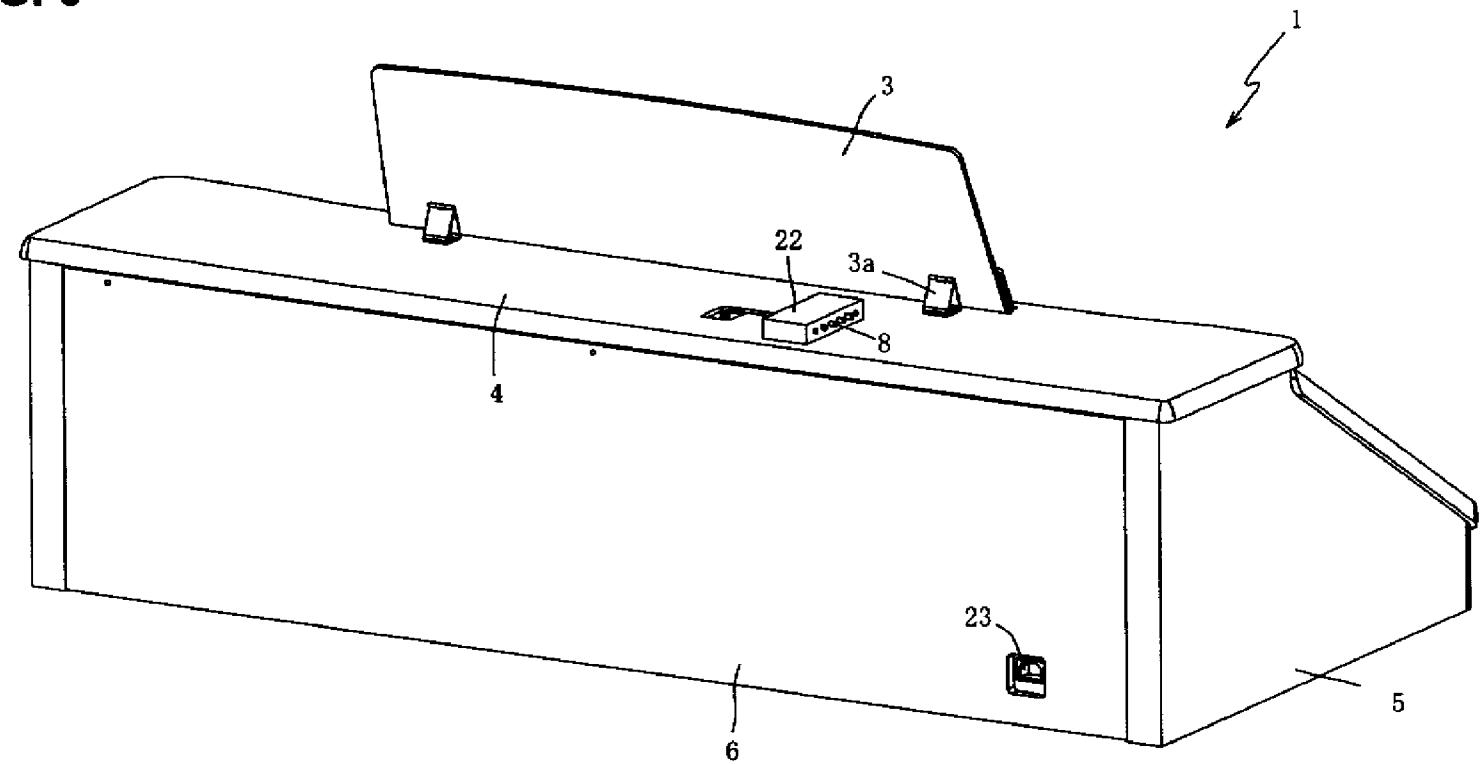
FIG. 5 is a perspective view of an electronic organ in accordance with a second embodiment of the invention.

Next, referring to FIG. 5, a second embodiment is described. In accordance with the first embodiment, the plural connection terminals 8 are provided in a manner to protrude upwardly from the top surface of the top board 4. In accordance with the second embodiment, for example, a box 22 formed from a steel plate is provided on the top surface of the top board 4 in the rear of the music stand 3, and the connection terminals 8 are provided on a side surface of the box 22. It is noted that the same reference numerals are used for common elements described in the different embodiments of FIGS. 1, 2, and 5.

With respect to FIG. 5, box 22 is in an elongated cuboid extending from the front to the back of the top board and is provided with a plurality of connection terminals 8 in a manner to protrude from a left-side side surface of the box 22 as viewed from the side of the keyboard 2. Accordingly, the connection terminals 8 can be viewed from the side of the side board 5 on the left side, and the connection terminals of the connection cords 51 (FIG. 2) for connecting the connection terminals 8 with the external equipment 50 can be readily connected or disconnected from the left side of the electronic organ 1.

Figure 6:
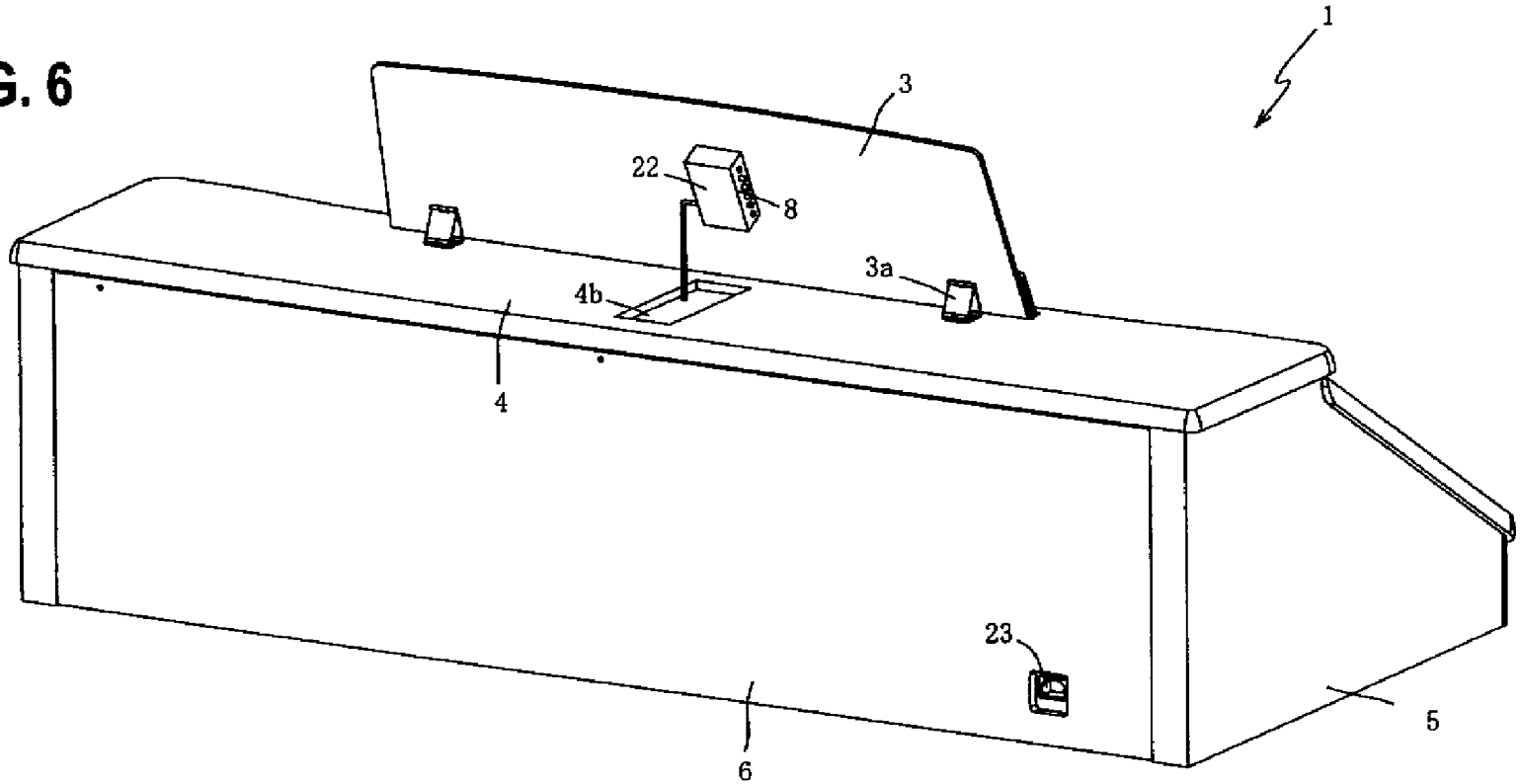
FIG. 6 is a perspective view of an electronic organ in accordance with a third embodiment of the invention.

Next, referring to FIG. 6, a third embodiment is described. In accordance with the second embodiment, the box 22 is provided on the top surface of the top board 4. In accordance with the third embodiment, the box 22 is disposed on the back surface of the music stand 3. The box 22 is provided with a plurality of connection terminals 8 in a manner to protrude to the left from its left side surface, like the second embodiment. Accordingly, the connection terminals 8 can be viewed from the side of the side board 5 on the left side.

Also, the music stand 3 can be swung forward, as in the embodiment described with respect to FIGS. 1, 2, 3A and 3B, such that when the music stand 3 in FIG. 6 is swung to a position where the music stand 3 is positioned above the keyboard 2, the back surface of the music stand 3 faces upward, and the box 22 disposed on the back surface of the music stand 3 is moved to a position above the keyboard 2, which is closer to the front side of the keyboard 2. Therefore, the connection terminals of the connection cords 51 connected to the external equipment 50 can be more readily connected to or disconnected from the connection terminals 8.

Also, with respect to FIG. 6, a concave section 4*b* may be formed in the top surface of the top board 4 in a manner to oppose the box 22, as shown in FIG. 6. The music stand 3 may also be made to be rearwardly swingable such that, as the music stand 3 is swung down to the rear, the box 22 is stored inside the concave section 4*b*, and the music stand 3 can be placed in parallel with the top board 4.

While particular embodiments have been described, it is obvious to those skilled in the art that the invention is not limited to the particular embodiments described above and that many changes and modifications can be made without departing from the subject matter of the invention.

For example, in accordance with the embodiments described above, the connection terminals provided on the electronic organ 1 and the connection terminals provided on the external equipment 50 are connected through the connection cords 51. However, connection terminals that may be provided on the external equipment 50 and the connection terminals provided on the electronic musical instrument 1 may be directly connected to one another. When plural connection terminals are mutually connected, a plurality of corresponding connection terminals may be disposed in each of the opposing faces of the electronic musical instrument 1 and the external equipment 50, and the two sets of the plural connection terminals can be connected or disconnected simultaneously.

Also, according to each of the embodiments described above, audio signals and video signals are connected to the external equipment 50 through independent connection terminals. However, a single connection terminal, such as, a USB terminal or an IEEE 1394 terminal may be used such that audio signals and video signals may be transmitted or received in packets. Also, the USB terminal and IEEE 1394 can be used for transmission and reception of MIDI signals.

Furthermore, in accordance with the embodiments described above, the music stand 3 is made swingable by the hinges 3*b* affixed to the top surface of the top board 4. However, in another aspect, a groove may be formed in the top surface of the top board 4, and the bottom edge of the music stand 3 may be inserted in the groove, whereby the music stand 3 may be mounted without being affixed to the top board 4 using screws.

Moreover, in the embodiments described above, description of the power cord for the external equipment 50 is omitted. However, the terminal for supplying power may be provided as one of the connection terminals 8.

Also, in the embodiments described above, the music stand 3 is structured not to swing to the rear side (over the top board). However, the supporting metal fittings 4*a* may be structured to be readily removed or folded to allow the music stand 3 to swing to the rear. As a result, when the electronic organ 1 is to be stored, the volume of the electronic organ 1 can be reduced.

Also, in accordance with the first embodiment of FIGS. 1 and 2, the connection terminals 8 are provided inside the concave section 4*a* formed in the top surface of the top board 4, and the tips of the connection terminals 8 do not protrude from the top surface of the top board 4. However, the tips of the connection terminals 8 may be flush with the top surface of the top board, or the tips of the connection terminals may slightly protrude from the top surface of the top board.

Furthermore, in accordance with the second embodiment of FIG. 5, the connection terminals 8 are provided on the side surface of the box 22 provided on the top surface of the top board 4, and the connection terminals 8 are disposed extending to the side of the electronic musical instrument 1. However, the connection terminals 8 may be arranged to extend in an upward, rearward or forward direction of the electrical musical instrument 1.

Figure 7:
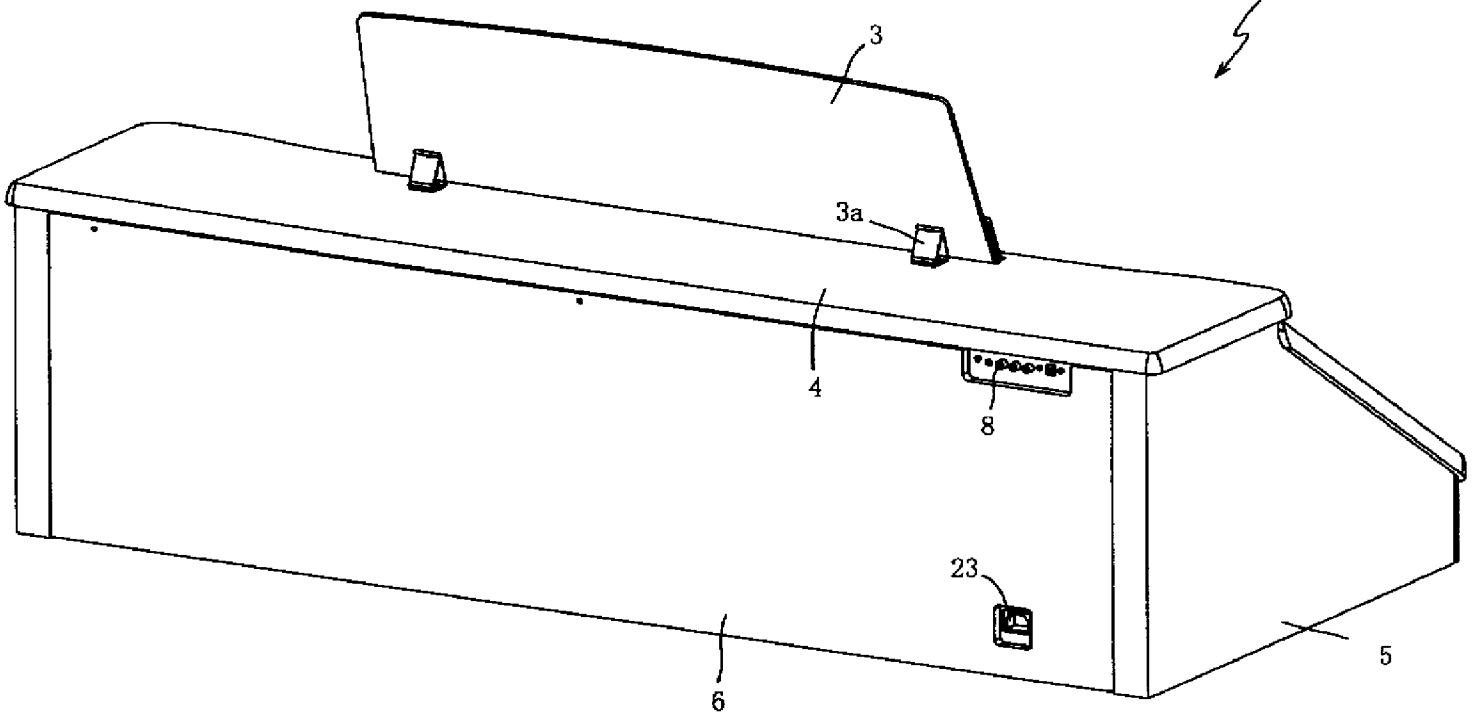
FIG. 7 is a perspective view of an electronic organ with connection terminals arranged in a back board, and adjacent to a top board of the electronic organ.
Figure 8:
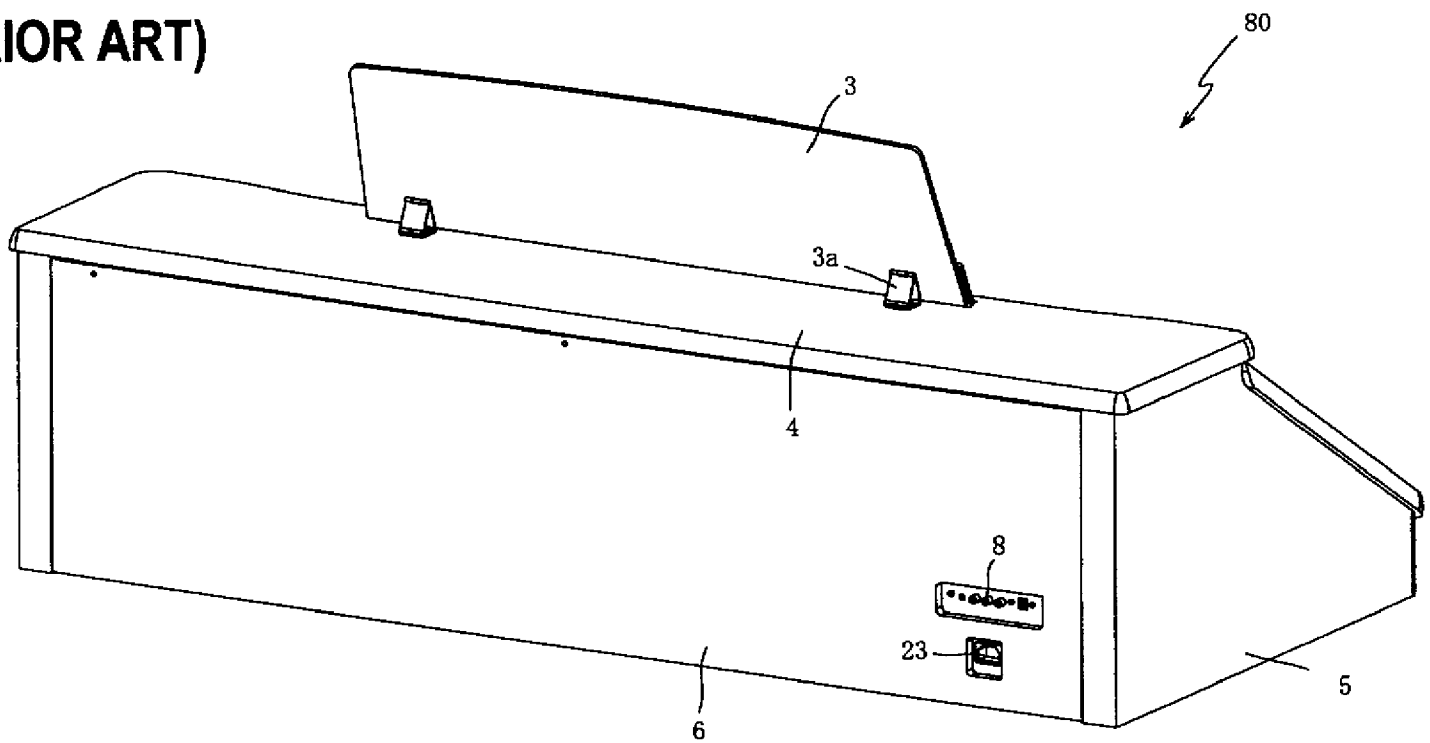
FIG. 8 (PRIOR ART)
FIG. 8 is a perspective view of an electronic organ in related art having connection terminals arranged in a back surface of the electronic organ as known in the prior art.

Also, when it is difficult to dispose the connection terminals 8 on the top surface of the top board 4 or in the rear of the music stand 3, the connection terminals 8 may be disposed at a higher position in the back board 6 adjacent to the top board 4, as shown in FIG. 7. As a result, the connection terminals 8 and the connection terminals of the external equipment 50 may be more readily connected or disconnected with one another, compared to the case shown in FIG. 8 where the connection terminals 8 are disposed at a lower position in the back board 6.

In accordance with an advantage of some aspects of the described embodiments, there is provided an electronic musical instrument that allows connection and disconnection of external equipment to be readily performed, and also enables wiring of the external equipment to be decently made. The connection with and disconnection from connection terminals of external equipment can be more readily made, compared to the case where connection terminals are provided in the back surface of the electronic musical instrument. Moreover, as the connection terminals are located in the rear of the music stand, the connection terminals and the connection cords are almost non-visible from the front side of the electronic musical instrument. Furthermore, the connection terminals are not provided in the back surface of the electronic musical instrument, which adds to the appearance of the back side of electronic musical instrument.

In certain embodiments, the use of a concave section receding in the top surface into which the connection terminals are disposed prevents the tips of the connection terminals from protruding from the top surface of the top board to allow a broader area to be available in the top surface of the top board when the connection terminals are not used.

In a further embodiment, using a convex portion on the top surface allows the location where the connection terminals are provided to be readily confirmed, and connection and disconnection of the connection terminals can be readily made. Further allowing the connection terminals to extend from the convex section toward a side of the instrument allows the user to visually confirm the connection terminals from the side of the electronic musical instrument, which can make connection and disconnection of the connection terminals easier.

In a further embodiment, locating the connection terminals on the rear of the music stand takes advantage of the space behind the music stand and allows for connection and disconnection of the connection terminals even when there is no space in the back of the electronic musical instrument. Also, a wider area can be made available for placing external equipment and the like on the top surface of the top board when using the rear of the music stand for the connection terminals.

In embodiments where the music stand has a back surface with a convex portion and the top board of the instrument has a top surface and concave section for storing the convex portion on the music stand, when the music stand is not used, the convex portion on the music stand can be stored in the concave section formed in the top board, such that the music stand can be placed with its back surface being in contact with the top surface of the top board.

In embodiments where the music stand is swingable toward a position above the keyboard about an axis, by swinging the music stand to the position above the keyboard, the terminals provided at the back of the music stand can be viewed from the front side of the keyboard, such that connection and disconnection of the connection terminals can readily be made.

In certain embodiments, the music stand may be swingable toward a position above the keyboard about an axis formed on the top surface of the top board. In this way, by swinging the music stand to the position above the keyboard, the back of the music stand faces upward, and the connection terminals provided on the back surface of the music stand are placed in a position viewable from the front side of the keyboard and moved to a position closer to the front side of the keyboard, whereby connection and disconnection of the connection terminals can be readily conducted.

In an embodiment where the connection terminals include a musical sound signal input terminal, by connecting a connection terminal that outputs musical sound signals of external equipment to the connection terminals, musical sounds provided by the sound source can be outputted together with musical sounds provided by the external equipment.

In an embodiment where the connection terminals include an image signal input terminal, the electronic musical instrument can display images outputted from the external equipment.

With described embodiments, the electronic musical instrument can input and output any of the musical sound signals, the image signals, the MIDI signals, the USB signals, the IEEE1394 signals, and the electrical power with external equipment.

What is claimed is:

1. An electronic musical instrument comprising:

a keyboard having a plurality of keys located at a front side of the keyboard, wherein the keyboard has a back side, rear side, left side, and right side;

a top board located at the back side of the keyboard and having a space for placing external equipment;

a music stand that is erected on the top board; and a plurality of connection terminals that are located on a top surface of the top board between the music stand and the back side of the keyboard, and that are freely connected with and disconnected from the external equipment.

2. The electronic musical instrument of claim 1, wherein the top board has a concave section that recedes in the top surface of the top board, and the connection terminals are provided inside the concave section formed in the top board.

3. The electronic musical instrument of claim 2, wherein the connection terminals are provided inside the concave section such that tips of the connection terminals are lower than the top surface of the top board.

4. The electronic musical instrument of claim 1, wherein the top board has a convex portion that protrudes from the top surface, and the connection terminals are provided at the convex portion provided on the top board.

5. The electronic musical instrument of claim 4, wherein the connection terminals extend from the convex section toward the left or the right side of the electronic musical instrument.

6. The electronic musical instrument of claim 1, wherein the music stand is swingable toward a position above the keyboard about an axis provided on top of the surface of the top board.

7. The electronic musical instrument of claim 1, wherein the connection terminals include a musical sound signal input terminal for inputting musical sound signals, and the electronic musical instrument further comprising a sound source that generates musical sounds specified through performance of the keyboard, and a musical sound output device that mixes and outputs musical sound signals generated by the sound source and musical sound signals inputted from the external equipment through the connection terminals.

8. An electronic musical instrument comprising:

a keyboard having a plurality of keys located at a front side of the keyboard, wherein the keyboard has a back side, rear side, left side, and right side;

a top board located at the back side of the keyboard and having a space for placing external equipment;

a music stand that is erected on the top board; and a plurality of connection terminals including an image signal input terminal, wherein the connection terminals are located on a top surface of the top board between the music stand and the back side of the keyboard, and that are freely connected with and disconnected from the external equipment; and a display device that displays an image based on an image signal inputted through the image signal input terminal.

9. The electronic musical instrument of claim 1, wherein the connection terminals input or output at least one of musical sound signals, image signals, MIDI signals, USB signals, IEEE1394 signals, and electrical power.

10. An electronic musical instrument comprising:

a keyboard having a plurality of keys;

an audio circuit receiving musical sounds from a sound source to produce sound output for the keyboard;

a top board located in a rear of the keyboard and having a space for placing external equipment;

a music stand that is erected on the top board; and a plurality of connection terminals that are located in a back side of the music stand, and that are freely, electrically connected with and disconnected from the external equipment, wherein the connection terminals electrically connect the external equipment to the audio circuit.

11. The electronic musical instrument of claim 10, wherein the music stand has a back surface and a convex portion protruding from the back surface, and wherein the connection terminals are provided at the convex portion formed on the music stand.

12. The electronic musical instrument of claim 11, wherein the top board has a top surface and a concave section formed in the top surface for storing the convex portion formed on the music stand.

13. The electronic musical instrument of claim 10, wherein the music stand is swingable toward a position above the keyboard about an axis provided on the top surface of the top board.

14. The electronic musical instrument of claim 10, wherein the connection terminals include a musical sound signal input terminal for inputting musical sound signals, and the electronic musical instrument further comprising a sound source that generates musical sounds specified through performance of the keyboard to input to the audio circuit, and a musical sound output device that outputs sound output from the audio circuit rendered from musical sound signals generated by the sound source and musical sound signals inputted through the connection terminals from the external equipment.

15. The electronic musical instrument of claim 10, wherein the connection terminals include an image signal input terminal, and the electronic musical instrument further comprising a display device that displays an image based on an image signal inputted through the image signal input terminal.

16. The electronic musical instrument of claim 10, wherein the connection terminals input or output at least one of musical sound signals, image signals, MIDI signals, USB signals, IEEE1394 signals, and electrical power.

17. An electronic musical instrument comprising:

a keyboard having a plurality of keys located at a front side of the keyboard, wherein the keyboard has a back side, rear side, left side, and right side;

a top board located at the back side of the keyboard and having a space for placing external equipment;

a music stand that is erected on the top board;

an audio circuit receiving musical sounds from a sound source to produce sound output for the keyboard; and a connection terminal located on a top surface of the top board between the music stand and the back side of the keyboard on the top surface that is freely connected with and disconnected from external equipment, wherein the connection terminal electrically connects the external equipment to the audio circuit.

18. The electronic musical instrument of claim 17, further comprising:

a sound source generating musical sounds to input to the audio circuit, wherein the external equipment provides audio signals to the audio circuit via the connection terminal, and wherein the audio circuit renders output from the audio signals from the external equipment and the musical sounds from the sound source.

* * * * *